US006142746A

United States Patent [19]

Lundgren

[11] Patent Number: 6,142,746

[45] Date of Patent: Nov. 7, 2000

[54] PULSATING VALVE FOR HYDRAULIC RAMS HAVING A LIQUID VESSEL ATTACHED THERETO

[76] Inventor: Lars-Olof Lundgren, Hallhultsv 2, S-571 75 Fredriksdal, Sweden

[21] Appl. No.: 09/284,485

[22] PCT Filed: Oct. 23, 1997

[86] PCT No.: PCT/SE97/01768

§ 371 Date: Jun. 15, 1999

§ 102(e) Date: Jun. 15, 1999

[87] PCT Pub. No.: WO98/17920

PCT Pub. Date: Apr. 30, 1998

[30] Foreign Application Priority Data

Oct. 23, 1996 [SE] Sweden ..... 9603900

[51] Int. Cl.[7] ..... F04F 7/02

[52] U.S. Cl. ..... 417/226

[58] Field of Search ..... 417/226, 225, 417/104, 92

[56] References Cited

U.S. PATENT DOCUMENTS

| | | | |
|---|---|---|---|
| 157,325 | 12/1874 | Grier | 417/226 |
| 175,078 | 3/1876 | Grier | 417/226 |
| 357,413 | 2/1887 | Richards | 417/226 |
| 529,914 | 11/1894 | Jones | 417/226 |
| 570,357 | 10/1896 | Waller | 417/92 |
| 706,727 | 8/1902 | Deming | 417/226 |
| 753,560 | 3/1904 | Earle | 417/226 |
| 755,467 | 3/1904 | Earle | 417/226 |
| 841,563 | 1/1907 | Northey | 417/226 |
| 936,244 | 10/1909 | Hesse | 417/226 |
| 1,102,217 | 6/1914 | Lester | 417/226 |
| 1,214,192 | 1/1917 | Lester | 417/226 |
| 1,530,182 | 3/1925 | Jordao, Jr. | 417/226 |
| 3,306,216 | 2/1967 | Warman | 417/92 |

*Primary Examiner*—Charles G. Freay
*Assistant Examiner*—Robert Z. Evora
*Attorney, Agent, or Firm*—Robert P. Bell

[57] ABSTRACT

A pump device is disclosed, comprising a supply tube 1, for a liquid with a relatively low head, an accumulator 3 connected to supply tube 1 via a one-way valve 2, an outlet tube 4 from the accumulator for liquid with a relatively high head, and an outlet valve, provided at the supply tube 1 after the accumulator, which outlet valve opens and shuts an outlet 5 at the supply tube 1. The pump device is primarily characterized in that the outlet valve comprises a damper 6 movable between a position, in which the opening 5 is left open, and a position, in which the opening 5 is closed.

11 Claims, 6 Drawing Sheets

PULSATING VALVE FOR HYDRAULIC RAMS HAVING A LIQUID VESSEL ATTACHED THERETO

CROSS-REFERENCE TO RELATED APPLICATIONS

This application is a 371 of PCT/SE97/01768 filed on Oct. 23, 1997.

FIELD OF THE INVENTION

The present invention relates to an improved hydraulic ram pump device.

BACKGROUND OF THE INVENTION

Hydraulic ram pump devices are known in the art. Such pump devices typically comprise a supply tube for receiving a liquid with a relatively low head, an accumulator connected to the supply tube via a one-way valve, an outlet tube from the accumulator for producing liquid with a relatively high head. An outlet valve, provided at an outlet of the supply tube, after the accumulator, outlet opens and shuts the outlet at the supply tube. Such hydraulic ram pumps have long been known in the art.

In such a Prior Art design, the outlet valve may be provided with a float, which is closed at a certain liquid flow, and opened again when the liquid flow has ceased. Such a pump operates well as long as the liquid fed, usually water, is free from impurities. Even small impurities may, however, disturb the operation of such an outlet valve, whereby the pump device of this type ceases to operate.

Thus there remains in the art a demand for hydraulic ram pump devices which are not disturbed by a reasonable amount of impurities in the actual liquid, and this have a reliable function and are simple in design and thus cheap in manufacture.

SUMMARY OF THE INVENTION

According to the present invention, such a hydraulic ram pump device is characterized in that the outlet valve comprises a damper movable between a first position, in which the opening is left open, and a second position, in which the opening is closed. The pump device according to the invention may be designed in various ways within the spirit and scope of the present invention. In one embodiment, the damper may be arranged to rotate around a first axis and is provided with an adjustable first weight which provides a torque acting in the direction towards the first open position of the outlet valve, and thus influences the time interval between opening and closing of the outlet valve.

In a second embodiment, which is particularly advantageous if the supply tube feeds liquid with a relatively low head, a vessel is provided, cooperating and coupled to the outlet valve. The vessel is movable between a first position and a second position. When the vessel is in the first position, the outlet valve is held open. The vessel collects flowing liquid from the outlet until the weight of the collected liquid brings the vessel to the second position in which the outlet valve is held closed.

Liquid then flows out of the vessel, and the reduction in weight allows the vessel to return to its first position. The vessel may be provided with a second variable weight, which provides a torque in the direction towards the first position of the vessel, and thus influences the time interval between the open and closed positions of the outlet valve.

The cooperation and coupling of the outlet valve with the vessel can be carried out in different ways. For example, the damper may be fixed to the vessel. In this case, a bow bar may be fixed to the vessel, provided to guide liquid, flowing from the outlet, to the vessel.

In another embodiment. where the damper is fixed to the vessel, a paddle wheel may be provided in such a way, rotatably mounted to a frame, such that liquid flowing from the outlet causes the paddle wheel to rotate and thereby transport the liquid into the vessel.

In order to achieve safe operation, it is possible, in one advantageous embodiment of the pump device of the present invention, to provide a vessel with a relatively small outlet opening to be filled with overflowing liquid and arranged to act, in an emptied condition, upon the outlet valve in the direction towards its open position. It is not necessary to fix the damper to the vessel in such an embodiment.

In yet another embodiment, the damper may be provided to pivot around a second axis between open and closed positions, and the vessel may be provided with a first element, such that when the vessel moves from the first position to the second position it acts upon a second element at the damper in order to close the outlet valve. Suitably, a guide rail may be provided to guide liquid to the second axis, in order to prevent the formation of ice at low temperatures.

The one-way valve may be designed in various ways. In one advantageous design the one-way valve may comprise an opening in the bottom of the accumulator, cooperating with a plate which at the lower side is provided with an elastic, sealing membrane. The plate may be guided such that it may be lifted at one end, opening a relatively large passage.

Even if the pump device according to the invention is primarily intended for use in pumping water with a relatively low head to a higher level, it may also be used in yet another embodiment, for compressing gas, particularly air. In this embodiment, the accumulator may be provided with a piston, arranged to glide in the accumulator. The piston may be designed with a relatively smaller surface, turned towards the liquid, coming from the supply tube, and a relatively larger surface, turned towards a chamber, to which is fed gas, preferably air, of a relatively low pressure via a first valve. The gas may be compressed by movement of the piston, caused by the pump device, and the compressed gas may then flow through a valve to a user.

BRIEF DESCRIPTION OF THE DRAWINGS

The invention will be described in more detail, reference being made to the enclosed schematic Figures of which.

DETAILED DESCRIPTION OF THE INVENTION

Figure 1A:
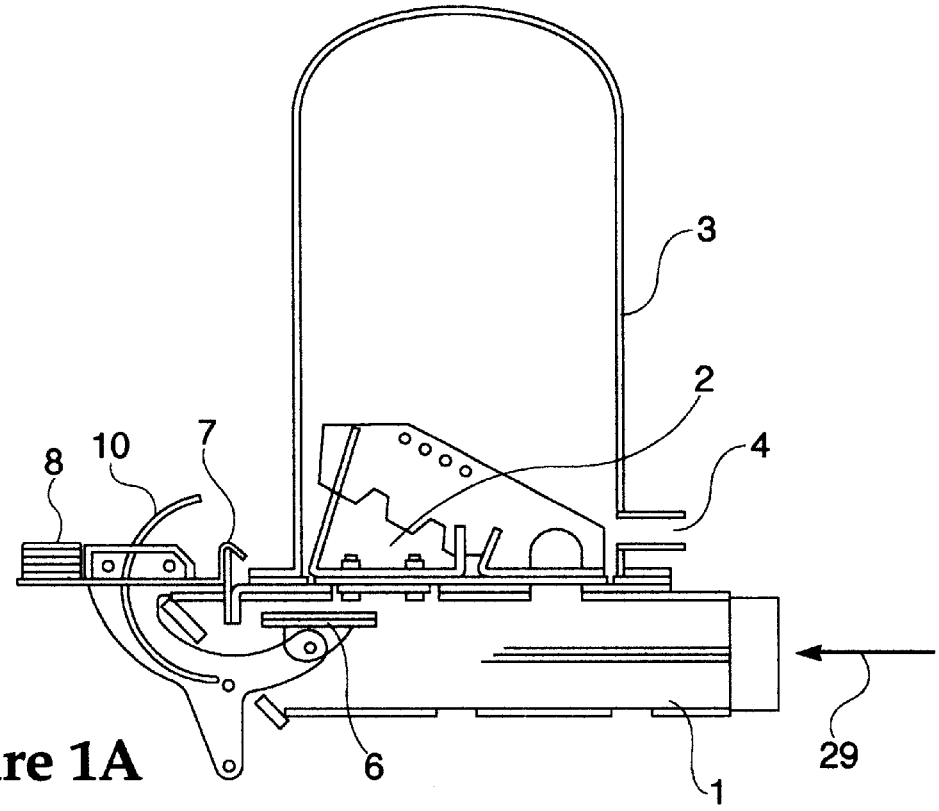
FIG. 1A illustrates one embodiment of the pump device according to the invention, in a cross-section side view, illustrating the outlet valve in an open position.
Figure 1B:
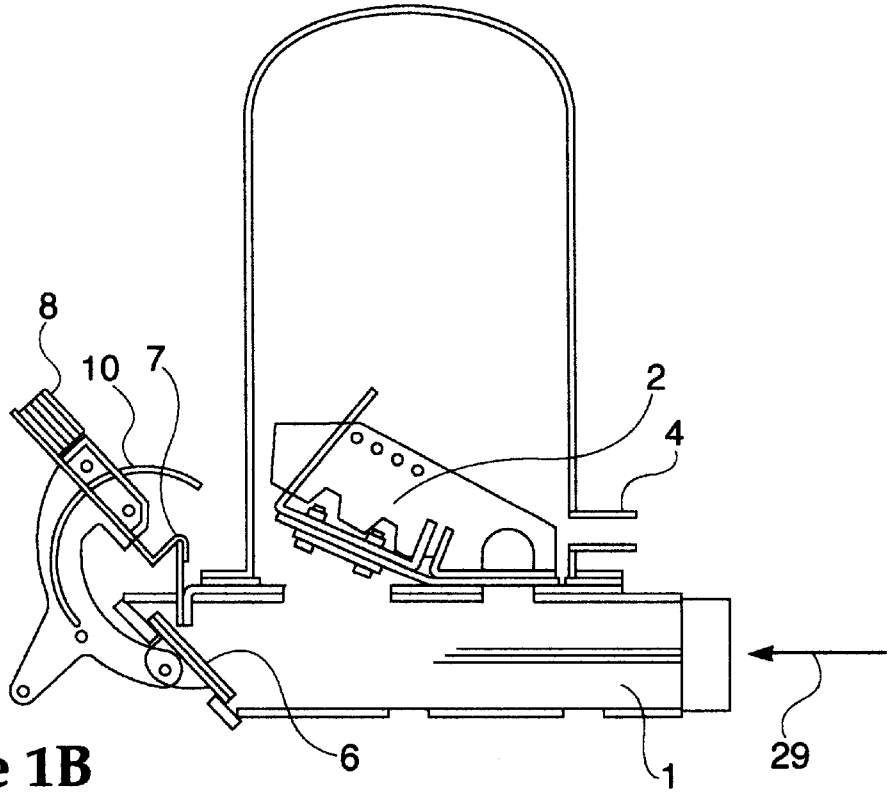
FIG. 1B illustrates the embodiment of the pump device according FIG. 1A, also in cross-section side view, illustrating the outlet valve in a closed position.

In FIGS. 1A and 1B a supply tube 1 for a liquid with a relatively low head, is fed according to arrow 29. Above supply tube 1 an accumulator 3 is provided, with a one-way valve 2 in the bottom and an outlet tube 4 for liquid with a relatively high head.

After accumulator 3 is provided an outlet valve at supply tube 1. The outlet valve comprises damper 6, movable between one position, in which an opening 5 at the supply tube is left open (FIG. 1A), and another position, in which opening 5 is closed (FIG. 1B). Damper 6 is arranged rotatable around a first axis 7, as is provided with a variable first weight 8, which provides a torque in the direction towards the open position of the outlet valve.

In operation, liquid, usually water, flows though supply tube 1 and out through opening 5, until opening 5 is closed by damper 6. When damper 6 closes, a pressure surge occurs opening one-way valve 2, such that pressure in accumulator 3 increases.

Figure 2A:
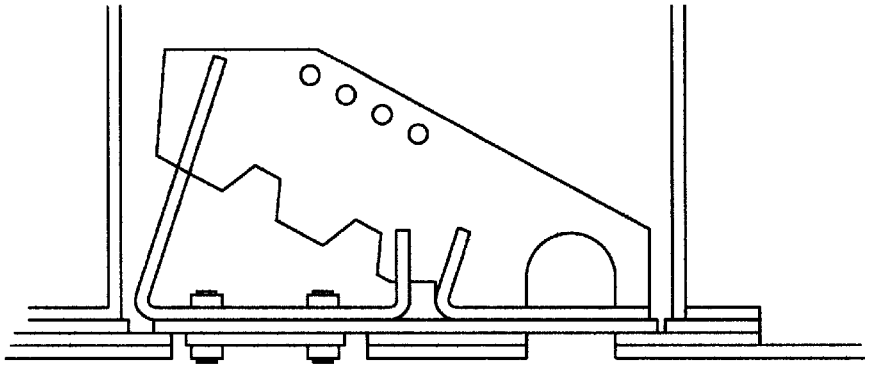
FIG. 2A is a cross-section side view of a one-way valve in a closed position.
Figure 2B:
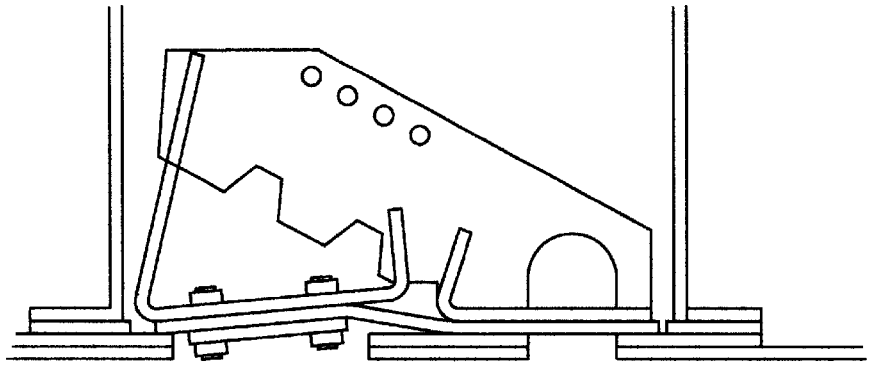
FIG. 2B is a cross-section side view of a one-way valve in a partly open position.
Figure 2C:
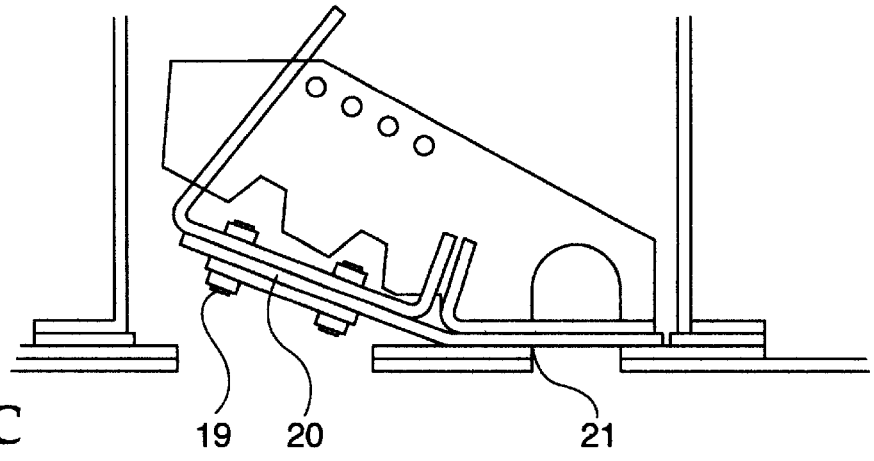
FIG. 2C is a cross-section side view of a one-way valve in an open position.

The one-way valve may comprise, in this embodiment as illustrated in FIGS. 2A–2C, of an opening 19 in the bottom of accumulator 3. A plate 19 cooperates with opening 19. At the lower side of the plate is provided an elastic sealing membrane. The plate being so guided such that it may be lifted at one end, opening a relatively limited passage, and that it may be lifted at the other end, opening a relatively larger passage. Variable weight 8 contributes to setting the interval between opening and closing of the outlet valve.

Figure 3:
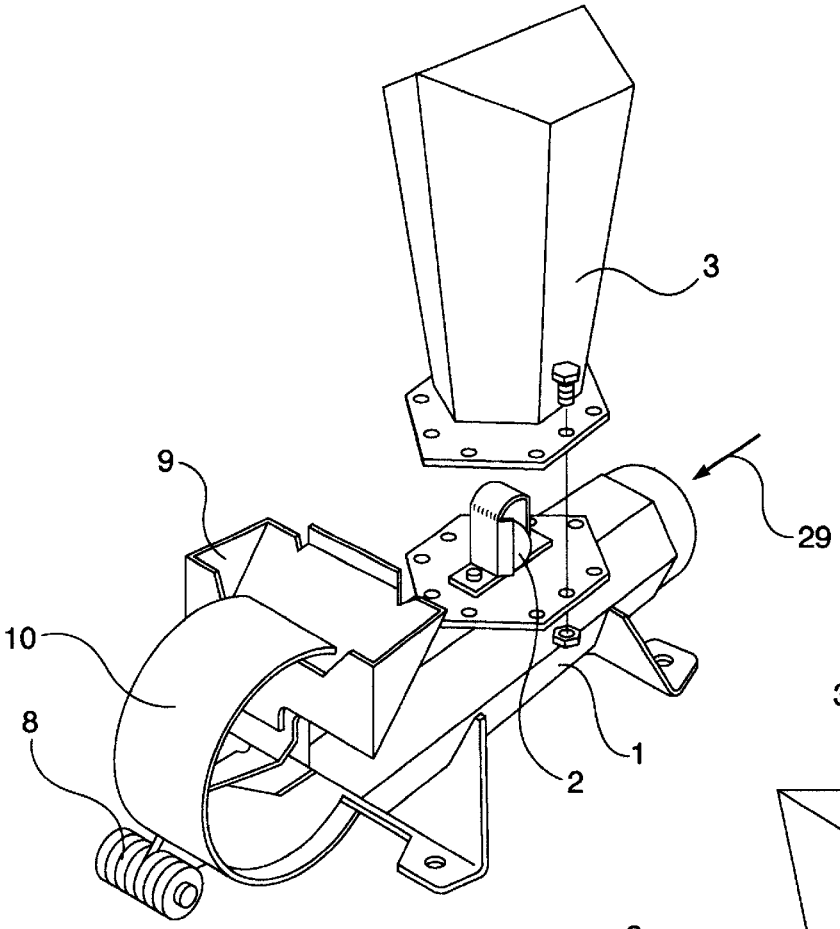
FIG. 3 is a perspective view, illustrating an alternative embodiment of the pump device, with the outlet valve in an open position.
Figure 4:
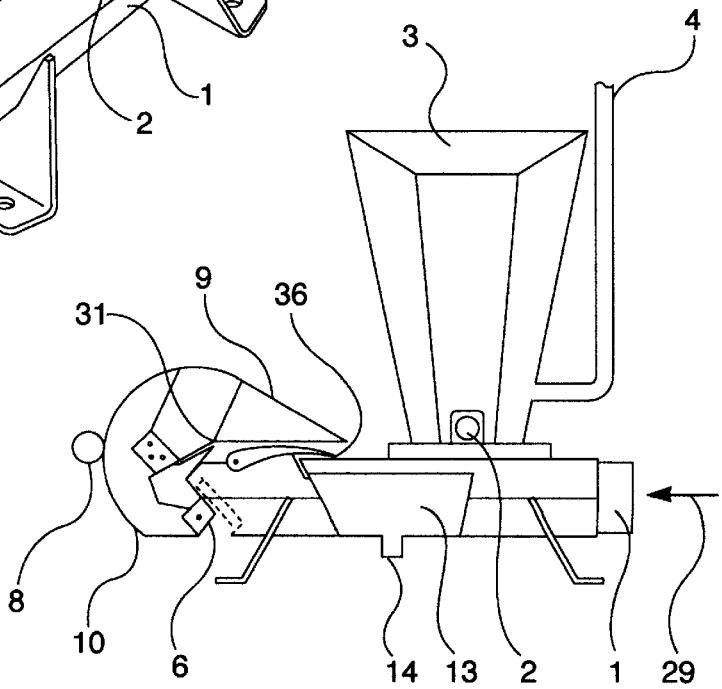
FIG. 4 is a side view of the pump device of FIG. 3 with the outlet valve closed.

In another embodiment illustrated in FIGS. 3 and 4, a vessel 9 is attached to damper 6 via a bow bar 10. Damper 6 with vessel 9 are swingable around an axis 31 between a first position, where the outlet valve is kept open while vessel 9 collects liquid flowing from the outlet until the collected liquid brings the vessel to take its second position when damper 6 is closed. A variable weight 8 may be attached to damper 6/vessel 9 and provides a torque acting in the direction towards the open position of the outlet valve, whereby the time interval between the opening and closing of the outlet valve can be controlled.

In FIG. 4, a device is illustrated for performing the function. Here, a vessel 13 is provided, hanging on an axis. Vessel 13 is provided with a relatively limited outlet opening 14 at the bottom side. Vessel 13 is filled intermittently by liquid flowing from vessel 9. Vessel 13 presses down on a spring 36 at the bottom of vessel 9 in its second position. When the liquid in vessel 13 has flown out, vessel 13 will be emptied though its outlet opening 14, whereby the spring 36 is released from its pressing weight, and is thereby brought to lift the vessel 9 in the direction of its first position, if the outlet valve for some reason should not turn back to its open position. Vessel 13 can also be filled directly from the outlet of supply tube 1.

Figure 5:
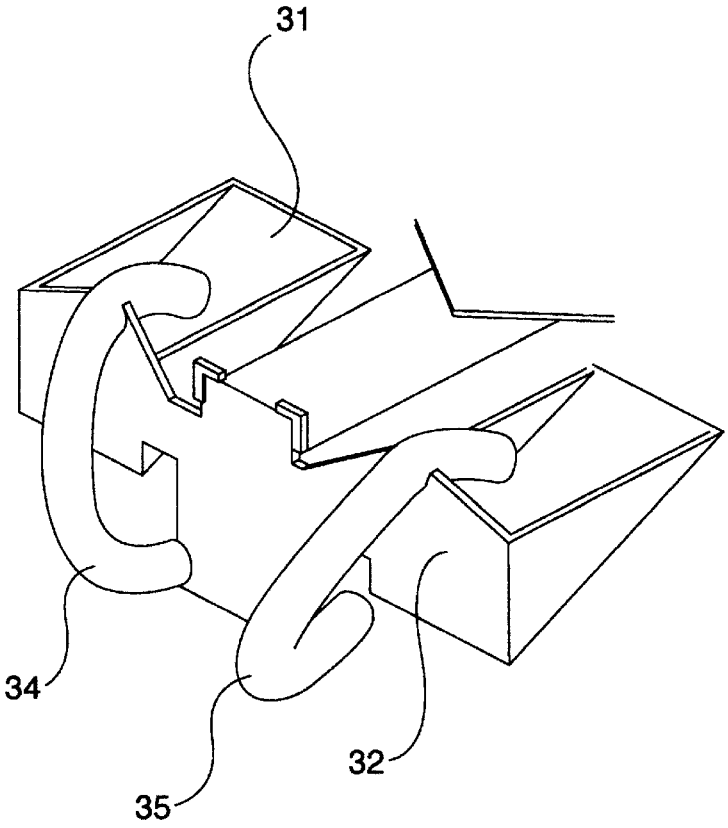
FIG. 5 is a perspective view illustrating a detail of another embodiment of the pump device.

FIG. 5 illustrates and embodiment where two vessels 32, 33 are attached to damper 6. Two bow formed tubes 34, and 35, which are attached to vessels 32, 33, may also be free from these and instead be attached to supply tube 1.

Figure 6:
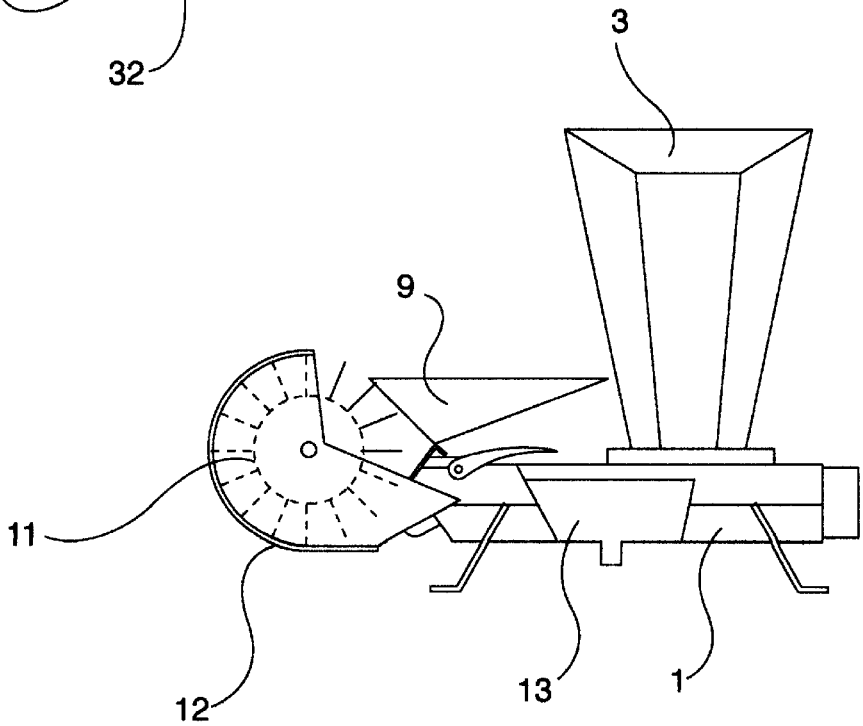
FIG. 6 is a side view illustrating one further view of the pump device.

The embodiment in FIG. 6 illustrates a paddle wheel 11 so arranged, rotatable in a housing 12, such that liquid, flowing from the outlet brings the paddle wheel 11 to rotate and thus feed the liquid to vessel 9.

Figure 7A:
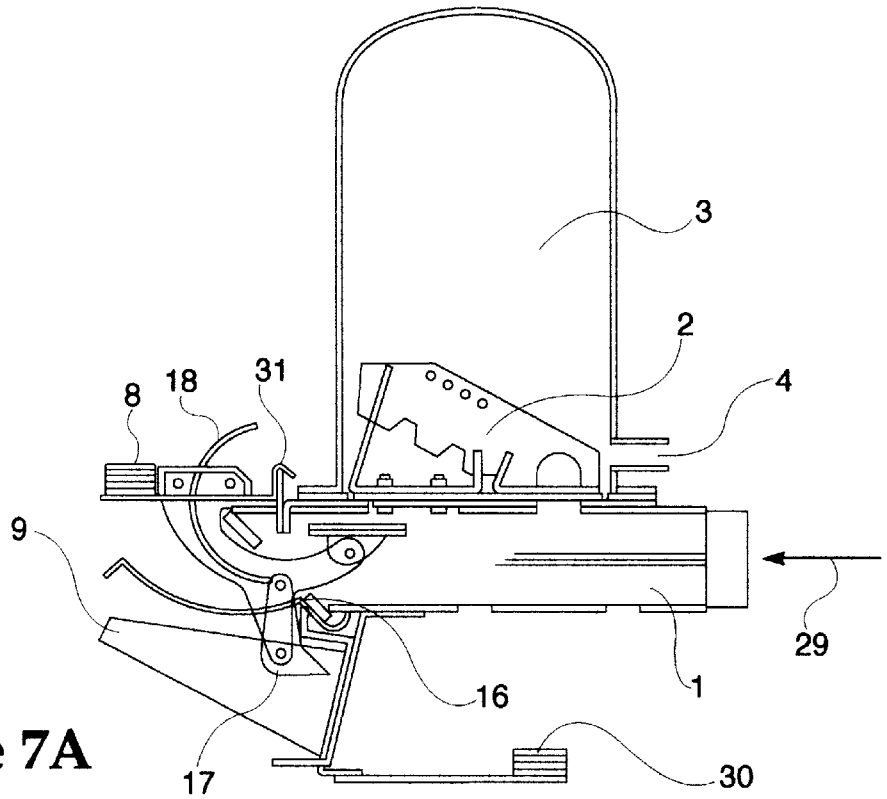
FIG. 7A is a side view of the preferred embodiment of the pump device in a first position.
Figure 7B:
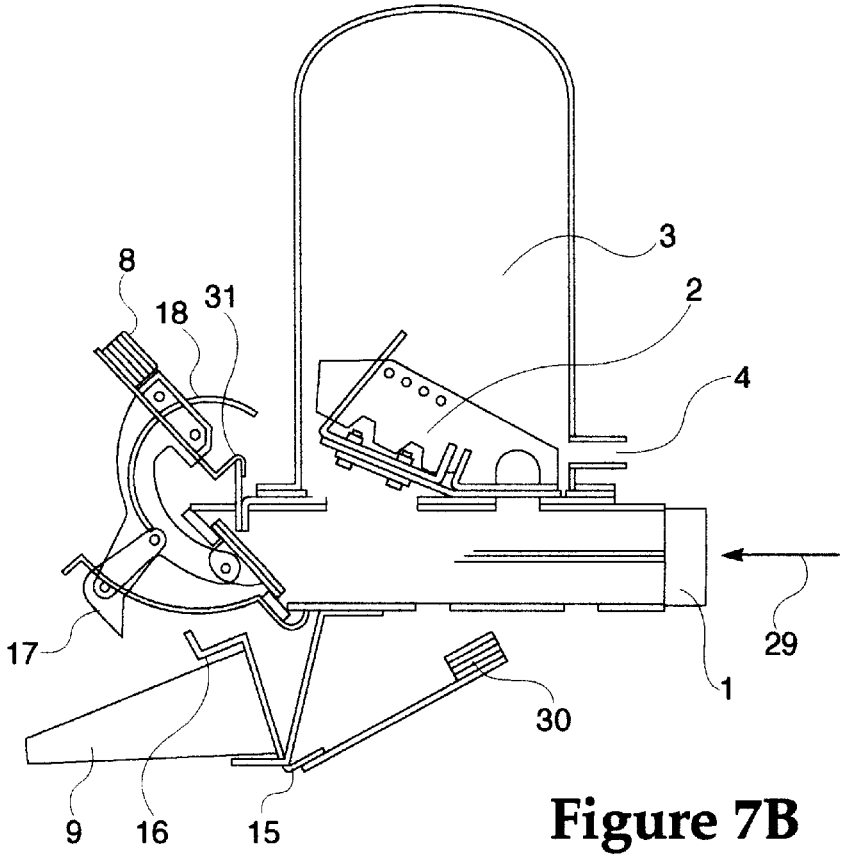
FIG. 7B is a side view of the preferred embodiment of FIG. 7A in a second position.

FIGS. 7A and 7B illustrate the preferred embodiment of the present invention, where damper 6 is provided rotatable around a horizontal axis 31 between its open and closed positions. Vessel 9 is rotatable around a relatively low axis and is provided with a first element 16 in the form of an arm, which is provided to act upon a second element 17 in the form of a second arm connected to damper 6 in such a way when vessel 9 moves from its first position (i.e., when liquid is filled in), to the second position, where liquid is emptied, the damper will be closed.

As the pump device may be used at temperatures below the freezing point for water, it is suitable to provide a guide rail 18, intended to guide some liquid to the axis 31 in order to prevent the formation of ice, which could prevent movement around axis 31.

Also within the scope of this embodiment, it may be suitable to provide variable weights for controlling the time interval between the opening and closing of the outlet valve. The damper may be provided with a variable weight 8, which provides the damper a torque directed towards an open position. Vessel 9 may be provided with a variable weight 30, which provides a torque in the direction towards the first position of the vessel and thus the open position of the damper.

Figure 8A:
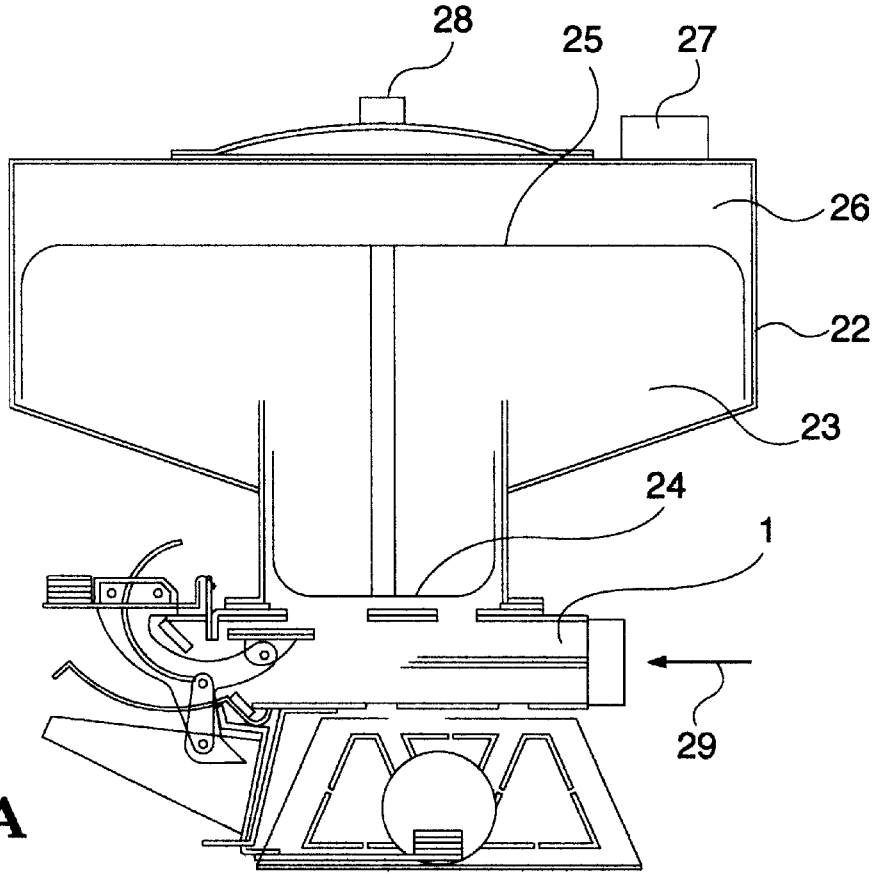
FIG. 8A is a side view illustrating one special embodiment provided for the compression of gas in a first position.
Figure 8B:
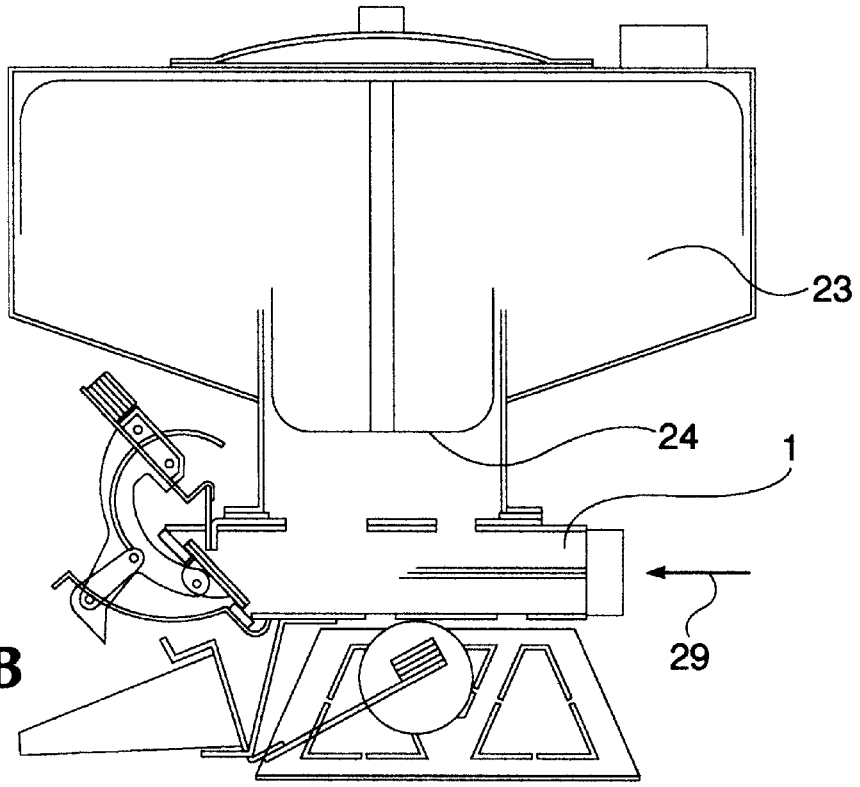
FIG. 8B is a side view illustrating one special embodiment provided for the compression of gas in a second position.

In the embodiment illustrated in FIGS. 8A and 8B, the accumulator 22 may be provided with a piston 23, arranged to glide in accumulator 22. Piston 23 is designed with a relatively smaller surface 24, turned towards the liquid coming from supply tube 1 through opening 19, which in this embodiment lacks a one-way valve. Piston 23 exposes a relatively larger surface 25 towards a chamber 26, to which is fed gas, preferably air, of a relatively low pressure via first valve 27. The gas may be compressed by the upward movement of piston 23, caused by the liquid, pressed in through opening 19. The compressed gas flows through a valve 28. Piston 23 returns by its won weight if by a spring (not shown).

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. A pump device comprising:

a supply tube for a liquid with a relatively low head;

an accumulator connected to the supply tube via a non-return valve;

an outlet tube from the accumulator for liquid with a relatively high head; and an outlet valve, provided at the supply tube after the accumulator, said outlet valve opens and shuts an outlet at the supply tube, wherein the outlet valve comprises a damper movable between an open position in which the outlet opening is left open, and a closed position in which the outlet opening is closed, wherein the damper is arranged rotatable around a first axis and is provided with a variable first weight, which provides a torque acting in the direction towards the open position of the outlet valve and thus influences a time interval between the opening and the closing of the outlet valve, wherein said pump device further comprises a vessel provided, cooperating with the outlet valve, said vessel being movable between a first position and a second position, whereas the outlet valve in the first position is kept open when the vessel continuously collects flowing liquid from the outlet, until the collected liquid brings the vessel to take the second position in which the outlet valve is kept closed until the liquid flows out from the vessel, whereby the vessel will return to its first position, and wherein the damper is rotatable around a second axis between the open and closed positions, and the vessel is provided with a first closure element which, when the vessel moves from said first position to the second position, acts upon a second element at the damper in order to close the outlet valve.

2. A pump device according to claim 1, wherein the non-return valve comprises an opening in the bottom of the accumulator, cooperating with a plate which at the lower side is provided with an elastic sealing membrane, the plate being so guided such that it may be lifted at one end, opening a relatively limited passage, and that it may be lifted at the other end, opening a relatively larger passage.

3. A pump device according to claim 1, wherein the first vessel is provided with a second variable weight providing a torque in a direction towards the first position of the first vessel, and thus influences the time interval between the open and closed position of the outlet valve.

4. A pump device according to claim 3, wherein the damper is fixed to the first vessel with a firm connection.

5. A pump device according to claim 4, further comprising:

a bow bar fixed to the first vessel provided to guide liquid flowing from the outlet to the first vessel.

6. A pump device comprising:

a supply tube for a liquid with a relatively low head;

an accumulator connected to the supply tube via a non-return valve;

an outlet tube from the accumulator for liquid with a relatively high head; and an outlet valve, provided at the supply tube after the accumulator, said outlet valve opens and shuts an outlet at the supply tube, wherein the outlet valve comprises a damper movable between an open position in which the outlet opening is left open, and a closed position in which the outlet opening is closed, wherein the damper is arranged rotatable around a first axis and is provided with a variable first weight, which provides a torque acting in the direction towards the open position of the outlet valve and thus influences a time interval between the opening and the closing of the outlet valve, wherein said pump device further comprises a first vessel provided, cooperating with the outlet valve, said first vessel being movable between a first position and a second position, whereas the outlet valve in the first position is kept open when the first vessel collects flowing liquid from the outlet, until the collected liquid brings the first vessel to take the second position in which the outlet valve is kept closed until the liquid flows out from the first vessel, whereby the first vessel will return to its first position, and wherein the first vessel is provided with a second variable weight providing a torque in a direction towards the first position of the first vessel, and thus influences the time interval between the open and closed position of the outlet valve.

7. A pump device according to claim 6, wherein the damper is fixed to the first vessel with a firm connection.

8. A pump device according to claim 7, further comprising:

a bow bar fixed to the first vessel provided to guide liquid flowing from the outlet to the first vessel.

9. A pump device according to claim 7, further comprising:

a paddle wheel provided rotatable in a housing such that liquid flowing from said outlet causes the paddle wheel to rotate and thereby transport the liquid to the first vessel.

10. A pump device according to claim 9, further comprising:

a second vessel with a relatively small outlet opening provided to be filled with overflowing liquid and is arranged to act in an emptied condition, upon the outlet valve in a direction towards the open position.

11. A pump device comprising:

a supply tube for a liquid with a relatively low head;

an accumulator connected to the supply tube via a non-return valve;

an outlet tube from the accumulator for liquid with a relatively high head; and an outlet valve, provided at the supply tube after the accumulator, said outlet valve opens and shuts an outlet at the supply tube, wherein the outlet valve comprises a damper movable between an open position in which the outlet opening is left open, and a closed position in which the outlet opening is closed, wherein the damper is arranged rotatable around a first axis and is provided with a variable first weight, which provides a torque acting in the direction towards the open position of the outlet valve and thus influences a time interval between the opening and the closing of the outlet valve, wherein said pump device further comprises a first vessel provided, cooperating with the outlet valve, said first vessel being movable between a first position and a second position, whereas the outlet valve in the first position is kept open when the first vessel collects flowing liquid from the outlet, until the collected liquid brings the first vessel to take the second position in which the outlet valve is kept closed until the liquid flows out from the first vessel, whereby the first vessel will return to its first position, wherein the damper is rotatable around a second axis between the open and closed positions, and the first vessel is provided with a first closure element which, when the first vessel moves from said first position to the second position, acts upon a second element at the damper in order to close the outlet valve, and wherein said pump device further comprises a guide rail provided to guide liquid to said second axis.

* * * * *